US005542609A

United States Patent [19]

Myers et al.

[11] Patent Number: 5,542,609

[45] Date of Patent: Aug. 6, 1996

[54] EXTENDED WEAR LIFE LOW PRESSURE DROP RIGHT ANGLE SINGLE EXIT ORIFICE DUAL-FLUID ATOMIZER WITH REPLACEABLE WEAR MATERIALS

[75] Inventors: Robert B. Myers, Norton; Ralph T. Bailey, Uniontown; David R. Burley, Akron; Steve Feeney, Norton; Barbara J. Gray, Canal Fulton; Dennis W. Johnson, Barberton, all of Ohio

[73] Assignee: The Babcock & Wilcox Company, New Orleans, La.

[21] Appl. No.: 271,336

[22] Filed: Jul. 6, 1994

[51] Int. Cl.[6] ..... B05B 7/04; B05B 1/00

[52] U.S. Cl. ..... 239/427; 239/589; 239/591

[58] Field of Search ..... 239/591, 433, 239/432, 427, 429, 589

[56] References Cited

U.S. PATENT DOCUMENTS

| | | | |
|---|---|---|---|
| 1,199,149 | 9/1916 | Best | 239/431 |
| 1,290,878 | 1/1919 | Barrows | 239/591 |
| 1,734,927 | 11/1929 | Tritz | 239/430 |
| 2,608,801 | 9/1952 | Ridley | 239/591 |
| 4,528,782 | 7/1985 | Bean | 239/591 |
| 4,679,733 | 7/1987 | Lipp | 239/432 |
| 4,819,878 | 4/1989 | Bailey et al. | 239/427 |
| 5,129,583 | 7/1992 | Bailey et al. | 239/427 |

FOREIGN PATENT DOCUMENTS

| | | | |
|---|---|---|---|
| 3602921 | 8/1987 | Germany | 239/591 |

*Primary Examiner*—Karen B. Merritt

*Attorney, Agent, or Firm*—Daniel S. Kalka; Robert J. Edwards

[57] ABSTRACT

A dual-fluid low pressure drop atomizer utilizes extended wear life material and comprises a nozzle head having a secondary mix chamber therein for receiving a mixture of a first compressible fluid and a second fluid containing solids from a primary mix chamber. The nozzle head also has an orifice therein communicating with and adjacent to the secondary mix chamber for discharging a jet of the mixture. The orifice and the secondary mix chamber form an approximate right angle therebetween. An inner barrel is connected to the nozzle head at the primary mix chamber and supplies the first fluid to the nozzle head. An outer barrel is arranged around the inner barrel creating an annulus therebetween and is also connected to the nozzle head for supplying the second fluid to the nozzle head. Wear resistant material provided in the primary and secondary mix chambers reduces erosion within the atomizer head.

14 Claims, 2 Drawing Sheets

EXTENDED WEAR LIFE LOW PRESSURE DROP RIGHT ANGLE SINGLE EXIT ORIFICE DUAL-FLUID ATOMIZER WITH REPLACEABLE WEAR MATERIALS

BACKGROUND OF THE INVENTION

1. Field of the Invention

The present invention relates, in general, to atomizers and, in particular, to a new and useful dual-fluid atomizer having a unique single exit orifice and replaceable wear materials.

2. Description of the Related Art

Generally, there are many types of atomizers that have been developed in order to atomize a fluid medium into a mist of fine particle size. Most atomizer designs are classified in one of the following categories: 1) hydraulic or mechanical atomizers wherein atomization is accomplished by discharging a fluid at high pressure through an orifice; 2) dynamic atomizers such as a high speed rotary disk or cup; and 3) dual-fluid atomizers in which fluid atomization is achieved by combining a liquid with a compressed gas such as air or steam.

Dual-fluid atomizers are further subdivided into two basic types, depending on the location where the atomizing gas and liquid are mixed, i.e. external to the atomizer or internal to the atomizer. With external mix dual-fluid atomizers, the gas and liquid streams are mixed external to the atomizer housing by impinging one jet against the other. With internal mix dual-fluid atomizers, the atomizing gas and liquid streams are mixed internal to the atomizer and discharged through single or multiple exit orifices.

For erosive applications where particle-laden liquids, i.e. slurries, are the atomized fluid, the type of atomizer is limited by practical constraints. These constraints include flow capacity, the required size of droplets in the atomized spray (i.e. particle size distribution), the size of internal flow passages, the physical durability of the atomizer components (i.e. service life), the atomizers sensitivity with respect to the degradation of performance due to dimensional change caused by the corrosive and/or erosive nature of the fluid to be atomized, and commercially acceptable energy requirements to produce the atomized spray.

There are many different internal mix dual-fluid atomizers that have been developed. U.S. Pat. Nos. 4,819,878 and 5,129,583 disclose two types of dual-fluid atomizers which are currently used.

SUMMARY OF THE INVENTION

The present invention is an extended wear life, low pressure drop, right angle, single exit orifice dual-fluid atomizer which utilizes replaceable wear materials. The unique arrangement of the present invention includes large size internal flow passages which allow for the passage of grit or other relatively large particles without clogging and at the same time produces fine atomization of the liquid fraction. The present invention also facilitates the use of corrosion/erosion resistant materials which fully line the internal wetted surfaces of the atomizer for extending the useful wear life of the atomizer while simultaneously reducing overall operating and maintenance requirements.

The present invention utilizes a gas such as compressed air or steam as the atomizing medium to produce a homogeneous mixture of finely atomized liquid droplets containing a uniform dispersion of solids. Where a liquid is not utilized, the present invention produces a fine distribution of powder particles.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which preferred embodiments of the invention are illustrated.

DESCRIPTION OF THE PREFERRED EMBODIMENTS

Figure 1:
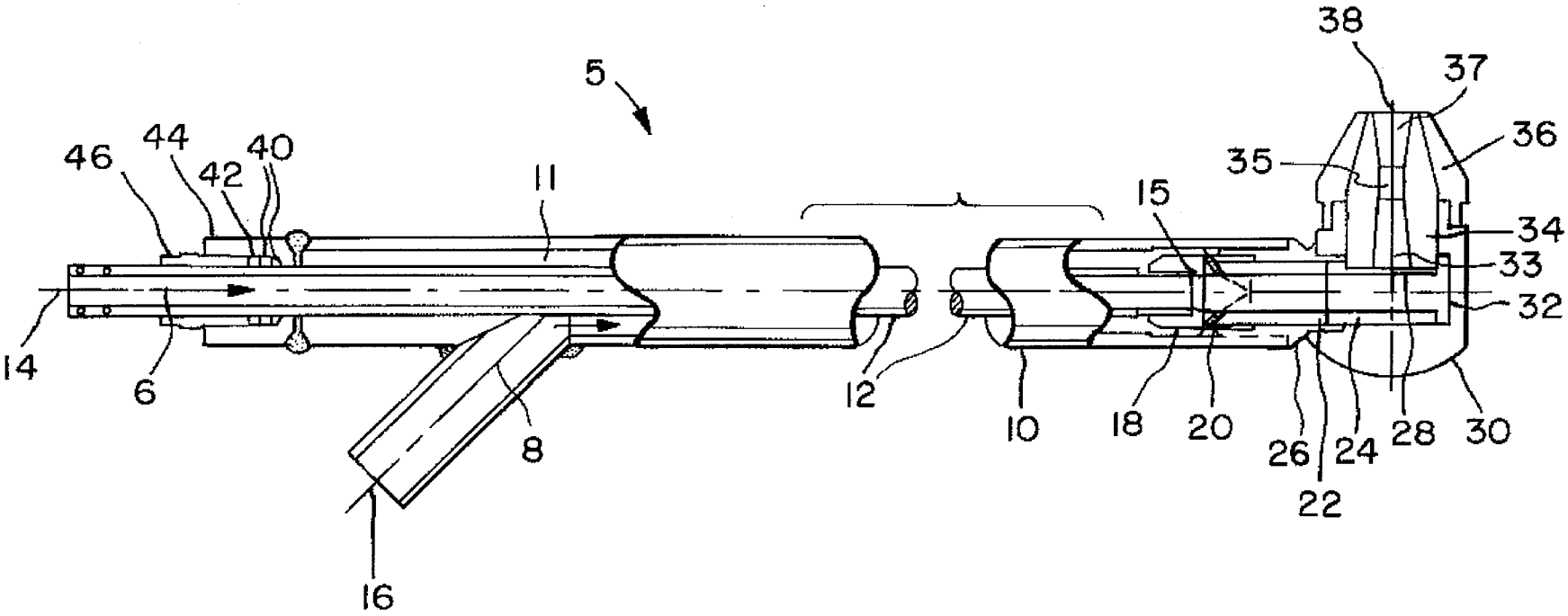
FIG. 1 is a sectional view of a dual-fluid atomizer according to the present invention.
Figure 2:
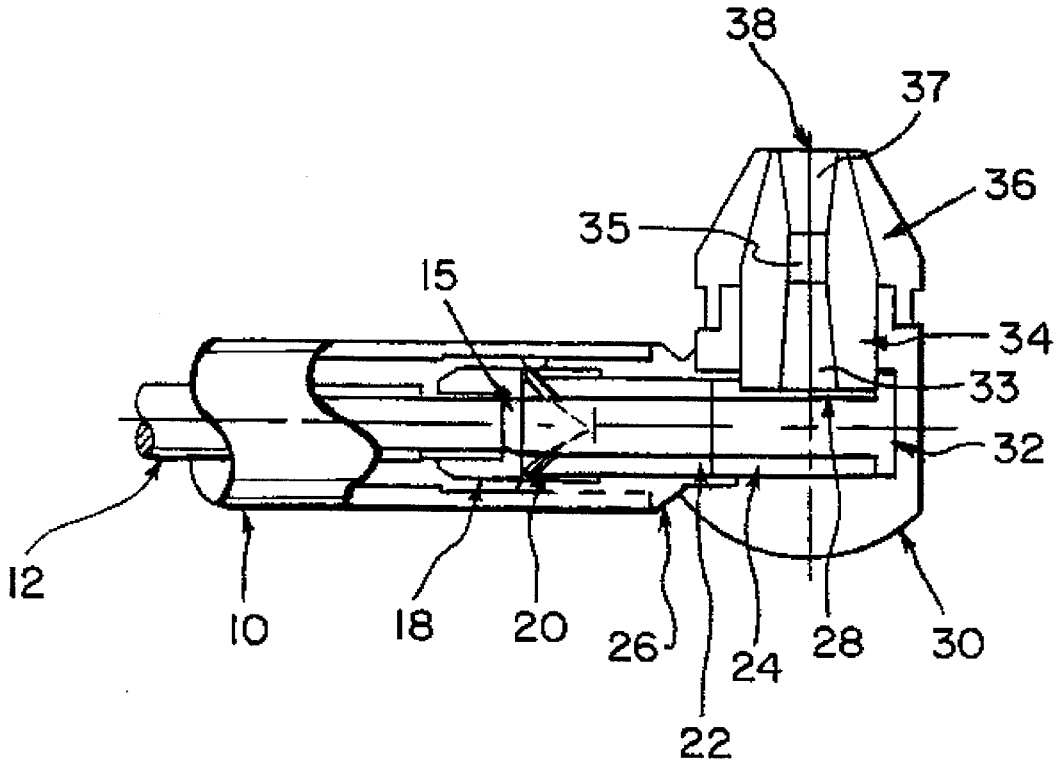
FIG. 2 is an enlarged sectional view of the atomizer head and outlet.

The present invention, as illustrated in FIG. 1, is a dual-fluid atomizer, generally designated 5, comprising an outer barrel 10 having an inner barrel 12 disposed therein and defining an annular space 11 therebetween. The inner barrel 12 has a port or opening 14 at one end for the entry of a slurry, solution, liquid or dry powder flow 6. The outer barrel 10 has an opening 16 for a gas, air, fluid or steam flow 8 which flows through annulus 11. The outer barrel 10 and the inner barrel 12 are connected to a mix chamber housing 18 of an atomizer housing 30. The outer barrel 10 and the inner barrel 12 are connected to the chamber housing 18 at their ends opposite openings 16 and 14, respectively. When the present invention is used in a preferred embodiment for atomizing a slurry, chamber housing 18 has an opening 15 which permits the entry of the slurry flow 6 into a primary mix chamber wear sleeve 22 and a secondary mix chamber wear sleeve 24 of the chamber housing 18. Adaptor coupling 26 secures the atomizer housing 30, the mix chamber housing 18 and outer barrel 10 and inner barrel 12.

Inner barrel 12 directs the slurry 6 at low velocities to the inlet of the primary mix chamber wear sleeve 22 where it is initially mixed with atomizing gas 8 provided by outer barrel 10 which enters the chamber 18 through gas ports 20 in the primary mix chamber wear sleeve 22.

In the primary mix chamber wear sleeve 22 of the chamber housing 18, a three-phase homogeneous mixture of gas, liquid and solid particles flow therethrough and into the secondary mix chamber wear sleeve 24 wherein it impacts a wear plug 32 located at one end of the secondary mix chamber wear sleeve 24 within the atomizer housing 30. Sleeves 22 and 24 along with wear plug 32 make up the wear-resistant material for the device, suitable wear-resistant material includes ceramic material. The homogeneous mixture is then directed to an inlet 28 of an orifice 34 in the atomizer housing 30 for eventual exit as a jet through outlet 38 of the orifice 34. Outlet 38 is provided through an end cap 36 which is provided on the atomizer housing 30.

The atomizer 5 secures the outer barrel 10 to the inner barrel 12 at an end opposite the atomizer housing 30 through the use of packing 40, a follower ring 42, a packing gland 44 and a packing gland nut 46.

The impact of the three-phase mixture of gas, liquid, and solid particles into the surface of the wear plug 32 results in the further break-up of liquid droplets and any agglomerated solid particles therein, ensuring complete homogenization of the three-phase mixture. Immediately following impact into the surface of the wear plug 32, the three-phase mixture turns 90 degrees and exits the secondary mix chamber wear sleeve 24 through port 28 where it is directed into the exit orifice 34. The three-phase mixture is then expanded through the exit orifice 34 causing the liquid phase to be atomized into a fine mist with a homogeneous distribution of solids particles as it exits at outlet 38.

Oversized particles that are contained in the slurry 6, from whatever source, are able to flow through the large atomizer ports 28 and 38 without obstruction. The large ports 28 and 38 also allow for low internal velocities, thereby minimizing both internal pressure losses and erosion. The configuration of the atomizer 5 facilitates the use of corrosion/erosion resistant materials, especially for the exit orifice 34 where velocities cannot be held below the threshold of erosion.

The wetted surfaces of the known internal mix dual-fluid atomizers are subjected to an extremely harsh operating environment due to the turbulent conditions created internally beginning at entry point where the atomizing gas and liquid or slurry are first combined together and ending at exit points for discharge. The operating pressure versus flow relationship and atomization performance characteristics of the dual-fluid atomizers are affected by dimensional changes of the internal wetted surfaces. As the wetted surfaces wear, especially the inner diameter of the discharge or exit orifice, atomization quality typically deteriorates to the point where process operations may be adversely effected, thus necessitating atomizer replacement. Furthermore, excessive internal wear may occur to the point of catastrophic atomizer failure.

Until now, the use of corrosion/erosion resistant materials to protect the wetted surfaces of internal mix dual-fluid atomizers for the purpose of extending the useful wear life while simultaneously reducing overall operating and maintenance requirements has been limited by design and/or manufacturing costs/considerations.

The present invention permits the use of replaceable corrosion/erosion resistant wear components manufactured in the form of simple shapes which are used to fully line the internal wetted surfaces of the right angle, single exit orifice dual-fluid atomizer 5 in order to extend its useful life while simultaneously reducing overall operating and maintenance requirements.

The manufacture and machining of many corrosion/erosion resistant materials such as certain alloys and ceramics can be very costly. By limiting the configuration of the mix chamber 18, exit orifice 34 and wear plug inserts 32 to that of simple cylindrical and disc shapes, not only can 100% lining of the internal wetted surfaces from the initial mix point to the point of discharge be achieved but also the difficulty and associated high costs to manufacture these components can be minimized.

The useful service life of the exit orifice insert 34 is significantly increased over that of the known designs through the addition of a straight section 35 located immediately downstream of inwardly tapered inlet end 33 of the exit orifice insert 34. The major advantage of the addition of the straight section 35 immediately downstream of the inwardly tapered inlet 33 over that of the known designs are improved wear characteristics resulting in an increase in the useful service life of the atomizer 5. With the known configurations, once the minor inner diameter (i.e. the point where the inwardly tapering inlet and the outwardly tapering outlet begins) of the exit orifice increases in diameter due to the corrosive/erosive nature of the atomized fluid, atomization performance characteristics begin to deteriorate.

For the present invention, the mix chamber inner diameter 18 is sized to maintain the velocity of the three-phase mixture of the atomizing gas, liquid, and solids in the range of 50 to 400 ft./sec. and preferably at a velocity of 200 ft./sec. The inner diameter of the mix chamber discharge port 28 is sized to maintain the velocity of the three-phase mixture of the atomizing gas, liquid, and solids in a range of 150 to 700 ft./sec. and preferably at a velocity of 400 ft./sec.

The mix chamber 18 is a simple two piece cylinder, i.e. sleeves 22 and 24 open at both ends with atomizing gas ports 20 located around its periphery. The effective length of the mix chamber 18 is defined as the distance between the point at which the centerline of the atomizing gas port 20 intersects the axial centerline of the mix chamber 18 to the point where the centerline of the discharge port 38 intersects perpendicular to the axial centerline of the mix chamber 18. The overall combined effective length of both the primary and secondary mix chamber wear sleeves 22 and 24 may be from 1.0 to 10.0 times the mix chamber internal diameter 18 with the optimum length being within a range of 2.0 to 5.0 times the mix chamber internal diameter 18.

The atomizing gas inlets 20 into the mix chamber 18 are one or more annulus, or a series of one or more holes, but not more than nine nor less than one mix chamber inner diameter upstream of the centerline of the secondary mix chamber sleeve discharge port 28. The direction of the ports must be greater than 15 degrees and not more than 90 degrees. The size of the ports is adjusted to keep the atomizing gas within the range of 100 to 700 ft./sec. The optimum number of atomizing gas ports 20 is three to four which allows for large passageways to prevent clogging by particles entrained in the atomizing gas, but still maintains balanced mixing of the atomizing gas with the fluid.

The fluid entrance port 15 in the mix chamber housing 18 is located along the axial centerline of the primary and secondary mix chamber wear sleeves 22 and 24 at the end opposite the discharge port 28. The fluid inlet must be a minimum of 0.25 times the mix chamber inner diameter upstream of the atomizing gas inlet ports 20. The size of the fluid inlet port 15 must be such so as to maintain the fluid velocity in the range of 0.5 to 40 ft./sec.

The exit orifice 34 is in an approximate FIG. 8 configured port and is formed by a tapered outlet section 37, straight section 35 and tapered inlet section 33. The included angle of the conical-shaped entrance port 33 is in a range of 15 to 120 degrees. The length of the conical-shaped entrance port 33 is in a range of 1 to 8 times the minor diameter of the exit orifice 34.

The length of the straight section 35 is from 0.5 to 5.0 times the minor inner diameter of the exit orifice 34, with the optimum length being in the range of 1.0 to 2.0 times the minor inner diameter. The included angle of the conical-shaped discharge port 37 is in a range of 3 to 14 degrees. The length of the conical-shaped discharge port 37 is in a range of 1 to 5 times the minor diameter of the exit orifice 34.

Major advantages for the present invention include the following: the configuration of the present invention permits the co-current or countercurrent injection of an atomized liquid solution, dry powder, or slurry into a gas steam flowing perpendicular or near perpendicular to the central axis (i.e. center line of the inner/outer barrels) of the atomizer; the configuration of the present invention permits the homogeneous mixing of the gas, liquid and/or solid particles to take place along the central axis (i.e. center line of the inner/outer barrels) of the atomizer before discharging at a right angle with respect to the central axis, thus minimizing the overall profile of the atomizer head; the configuration of the present invention permits the simple replacement of all internal wetted wear components; there is an improved exit orifice insert wear life resulting from lengthening the flow path of the minor diameter (i.e. addition of a straight section between the inwardly tapering inlet and the outwardly tapering outlet); and the exterior shape of the exit orifice, mix chamber and wear plug inserts are those of simple cylindrical and disc shapes, thus minimizing manufacturing costs.

While specific embodiments of the invention have been shown and described in detail to illustrate the application of the principles of the invention, it will be understood that the invention may be embodied otherwise without departing from such principles.

What is claimed is:

1. A dual-fluid low pressure loss and reduced deposition atomizer for discharging a jet of a first compressible fluid and a second fluid containing solids comprising:

a nozzle head having a secondary mix chamber therein for receiving and mixing an initially mixed mixture of the first fluid and the second fluid from a primary mix chamber, the head having a single orifice therein communicating with and adjacent to the secondary mix chamber for discharging the jet, the single orifice and the secondary mix chamber forming an approximate right angle therebetween;

first fluid supply means connected to the nozzle head for supplying the first fluid to the nozzle head;

second fluid supply means connected to the nozzle head for supplying the second fluid to the nozzle head; and means for resisting wear in the primary and secondary mix chambers.

2. The atomizer according to claim 1, wherein the primary and secondary mix chambers have a length from 1.0 to 10.0 times an internal diameter of the primary and secondary mix chambers.

3. The atomizer according to claim 2, wherein the orifice comprises an inwardly tapered inlet adjacent the secondary mix chamber followed by a straight section and then an outwardly tapering outlet.

4. The atomizer according to claim 3, wherein the first fluid supply means maintains a velocity for the first compressible fluid in a range approximately 50 to 750 ft./sec.

5. The atomizer according to claim 4, wherein the first compressible fluid is a gas.

6. The atomizer according to claim 5, wherein the second fluid is a member selected from the group consisting of slurry and solution.

7. The atomizer according to claim 4, wherein the first compressible fluid is steam.

8. A dual medium low pressure loss and reduced deposition atomizer for discharging a jet of a first compressible fluid medium and a second medium containing solids comprising:

a nozzle head having a secondary mix chamber therein for receiving and mixing an initially mixed mixture of the first fluid medium and the second medium from a primary mix chamber, the head having a single orifice therein communicating with and adjacent to the chamber for discharging the jet, the single orifice and the secondary mix chamber forming an approximate right angle therebetween;

first medium supply means connected to the nozzle head for supplying the first fluid medium to the nozzle head;

second medium supply means connected to the nozzle head for supplying the second medium to the nozzle head; and means for resisting wear in the primary and secondary mix chambers.

9. The atomizer according to claim 8, wherein the primary and secondary mix chambers have a length from 1.0 to 10.0 times an internal diameter of the primary and secondary mix chambers.

10. The atomizer according to claim 9, wherein the orifice comprises an inwardly tapering inlet adjacent the secondary mix chamber followed by a straight section and then an outwardly tapering outlet.

11. The atomizer according to claim 10, wherein the first medium supply means maintains a velocity for the first compressible fluid medium in a range approximately 50 to 750 ft./sec.

12. The atomizer according to claim 11, wherein the first compressible fluid medium is a gas.

13. The atomizer according to claim 12, wherein the second medium is a member selected from the group consisting of a powder, solution, and slurry.

14. The atomizer according to claim 11, wherein the first compressible fluid medium is steam.

* * * * *